US007592497B2

(12) United States Patent
Yang et al.

(10) Patent No.: US 7,592,497 B2
(45) Date of Patent: Sep. 22, 2009

(54) LOW VISCOSITY POLYALPHAPOLEFIN BASED ON 1-DECENE AND 1-DODECENE

(75) Inventors: Norman Yang, Westfield, NJ (US); Pramod Jayant Nandapurkar, Plainsboro, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 258 days.

(21) Appl. No.: 11/389,613

(22) Filed: Mar. 24, 2006

(65) Prior Publication Data

US 2007/0225535 A1 Sep. 27, 2007

(51) Int. Cl.
*C07C 2/08* (2006.01)

(52) U.S. Cl. ..... 585/525; 585/520; 585/521

(58) Field of Classification Search ..... 585/520, 585/521, 525
See application file for complete search history.

(56) References Cited

U.S. PATENT DOCUMENTS

| | | | | |
|---|---|---|---|---|
| 3,149,178 | A | 9/1964 | Hamilton et al. | 260/683.9 |
| 3,382,291 | A | 5/1968 | Brennan | 260/683.15 |
| 3,742,082 | A | 6/1973 | Brennan | 260/683.9 |
| 3,780,128 | A | 12/1973 | Shubkin | 260/683.9 |
| 4,045,507 | A | 8/1977 | Cupples et al. | 260/683.15 |
| 4,172,855 | A | 10/1979 | Shubkin et al. | 585/16 |
| 4,533,782 | A | 8/1985 | Merijanian | 585/520 |
| 4,956,122 | A | 9/1990 | Watts et al. | 252/565 |
| 5,196,635 | A | 3/1993 | Kumar et al. | 585/532 |
| 5,693,598 | A | 12/1997 | Abraham et al. | 508/444 |
| 6,071,863 | A | 6/2000 | Benda et al. | 508/591 |
| 6,303,548 | B2 | 10/2001 | Gao | 508/469 |
| 6,313,077 | B1 | 11/2001 | Stunnenberg et al. | 508/591 |
| 6,395,948 | B1 | 5/2002 | Hope et al. | 585/510 |
| 6,646,174 | B2 | 11/2003 | Clarembeau | 585/525 |
| 6,686,511 | B2 | 2/2004 | Miller et al. | 585/519 |
| 6,706,828 | B2 | 3/2004 | DiMaio | 526/160 |
| 6,713,582 | B2 | 3/2004 | DiMaio et al. | 526/281 |
| 6,824,671 | B2 | 11/2004 | Goze et al. | 208/19 |
| 6,869,917 | B2 | 3/2005 | Deckman et al. | 508/110 |
| 6,949,688 | B2 | 9/2005 | Goze et al. | 585/525 |
| 2001/0007851 | A1 | 7/2001 | Gao | |
| 2002/0128532 | A1 | 9/2002 | Hope et al. | 585/521 |
| 2002/0137636 | A1 | 9/2002 | Hartley et al. | 508/110 |
| 2003/0119682 | A1 | 6/2003 | Saini et al. | 508/167 |
| 2003/0166986 | A1 | 9/2003 | Clarembeau | 585/525 |
| 2004/0030075 | A1 | 2/2004 | Hope et al. | 526/237 |
| 2004/0033908 | A1 | 2/2004 | Deckman et al. | 508/110 |
| 2004/0129603 | A1 | 7/2004 | Fyfe et al. | 208/18 |
| 2004/0154957 | A1 | 8/2004 | Keeney et al. | 208/18 |
| 2004/0154958 | A1 | 8/2004 | Alexander et al. | 208/18 |
| 2006/0211904 | A1 | 9/2006 | Goze et al. | 585/520 |

FOREIGN PATENT DOCUMENTS

| | | |
|---|---|---|
| JP | 01095108 | 4/1989 |
| RU | 2212936 | 9/2003 |
| WO | WO 90/13620 | 11/1990 |
| WO | WO 99/38938 | 8/1999 |
| WO | WO 02/092729 | 11/2002 |
| WO | WO 2006/101583 | 9/2006 |

*Primary Examiner*—In Suk Bullock
(74) *Attorney, Agent, or Firm*—Andrew B. Griffis; Nancy T. Krawczyk

(57) ABSTRACT

The invention relates to a method of making a PAO from mixtures comprising 1-decene and 1-dodecene, characterized by a low viscosity and excellent cold temperature properties, using a promoter system comprising an alcohol. In embodiments, the product has properties similar to those obtainable using a feed of solely 1-decene.

18 Claims, No Drawings

LOW VISCOSITY POLYALPHAPOLEFIN BASED ON 1-DECENE AND 1-DODECENE

FIELD OF THE INVENTION

The invention relates to the use of 1-decene and 1-dodecene to produce low viscosity PAO having excellent low temperature properties.

BACKGROUND OF THE INVENTION

Poly α-olefins (polyalphaolefins or PAO) comprise one class of hydrocarbon lubricants which has achieved importance in the lubricating oil market. These materials are typically produced by the polymerization of α-olefins in the presence of a catalyst such as $AlCl_3$, $BF_3$, or $BF_3$ complexes. Typical α-olefins for the manufacture of PAO range from 1-octene to 1-dodecene. It is known to make polymers using higher olefins, such as 1-tetradecene, as described in WO 99/38938, and lower olefins, such as ethylene and propylene including copolymers of ethylene with higher olefins, as described in U.S. Pat. No. 4,956,122. Oligomerization is typically followed by fractionation and by a step of hydrogenation to remove unsaturated moieties in order to obtain the desired product slate. In the course of hydrogenation, the amount of unsaturation is generally reduced by greater than 90%.

PAOs are commonly categorized by the numbers denoting the approximate viscosity or "nominal viscosity", in centistokes (cSt), of the PAO at 100° C. PAO products may be obtained with a wide range of viscosities varying from highly mobile fluids with a nominal viscosity of about 2 cSt at 100° C. to higher molecular weight, viscous materials which have viscosities exceeding 100 cSt at 100° C. Viscosities as used herein are Kinematic Viscosities determined at 100° C. by ASTM D-445, unless otherwise specified.

PAOs may also be characterized by other important properties, depending on the end use. For instance, a major trend in passenger car engine oil usage is the extension of oil drain intervals. Due to tighter engine oil performance, a need exists for low viscosity PAO products with improved physical properties, e.g., evaporation loss as measured by, for instance, Noack volatility, as well as excellent cold weather performance, as measured by, for instance, pour point or Cold Crank Simulator (CCS) test. Noack volatilities are typically determined according to ASTM D5800; pour points are typically determined according to ASTM D97; and CCS is obtained by ASTM D5293.

PAOs are normally produced via cationic oligomerization of linear alpha olefins (LAOs). Low viscosity PAOs have been produced by $BF_3$-catalyzed oligomerizations based on 1-decene for many years. Processes for the production of PAO lubricants have been the subject of numerous patents, such as U.S. Pat. Nos. 3,149,178; 3,382,291; 3,742,082; 3,780,128; 4,045,507; 4,172,855; and more recently U.S. Pat. Nos. 5,693,598; 6,303,548; 6,313,077; U.S. Applications 2002/0137636; 2003/0119682; 2004/0129603; 2004/0154957; and 2004/0154958, in addition to other patent documents cited herein.

The properties of a particular grade of PAO are greatly dependent on the α-olefin used to make that product, as well as the catalyst used and other process details. In general, the higher the carbon number of the α-olefin, the lower the Noack volatility and the higher the pour point of the product. PAO's having a nominal viscosity at 100° C. of 4 cSt are typically made from 1-decene and have a Noack volatility of 13-14% and pour point of <−60° C. PAO's having a nominal viscosity at 100° C. of 6 cSt are typically prepared from 1-decene or a blend of α-olefins and have a Noack volatility of about 7.0% and pour point of about −57° C. PAOs having a nominal viscosity at 100 C of 8 cSt typically have a Noack volatility of about 4% and a pour point of −51 C. For 10 cSt PAOs, the pour point typically is about −48 C. PAOs made from LAOs that have molecular weights higher than 1-decene typically have higher pour points but lower viscosities at low temperatures. These effects are generally caused by waxiness of the oligomerized molecules. PAOs made from very low molecular weight LAOs such as 1-hexene, also have high pour point as well as high viscosity at low temperature. These effects could be attributed to the formation of branched molecules coupled with viscosity increases.

In the past, when oligomerizing LAO mixtures, mixtures of high and low molecular weight LAOs are generally used in an attempt to offset the properties and arrive at PAOs roughly similar in properties to C10-based oligomers. It is becoming increasingly more difficult for the industry to keep up with the demand for lubricating basestocks having properties similar to C10-based PAOs, and thus there are continual efforts to extend the range of linear alphaolefins that could be used to make such basestocks.

U.S. Pat. No. 6,071,863 discloses PAOs made by mixing C12 and C14 alphaolefins and oligomerizing using a $BF_3$-n-butanol catalyst. While the biodegradability of the product was reported to be improved when compared with a commercial lubricant, the exemplified pour points were −39° C., i.e., significantly higher than the commercial lubricant patentee used as the comparison. See also WO 99/38938.

In U.S. Pat. No. 6,646,174, a mixture of about 10 to 40 wt. % 1-decene and about 60 to 90 wt. % 1-dodecene are co-oligomerized in the presence of an alcohol promoter. Preferably 1-decene is added portion-wise to the single oligomerization reactor containing 1-dodecene and a pressurized atmosphere of boron trifluoride. Product is taken overhead and the various cuts are hydrogenated to give the PAO characterized by a kinematic viscosity of from about 4 to about 6 cSt at 100° C., a Noack weight loss of from about 4% to about 9%, a viscosity index of from about 130 to about 145, and a pour point in the range of from about −60° C. to about −50° C.

In U.S. Pat. No. 6,824,671, a mixture of about 50 to 80 wt. % 1-decene and about 20 to 50 wt. % 1-dodecene is oligomerized in two continuous stirred-tank reactors in series using $BF_3$ with an ethanol:ethyl acetate promoter. Monomers and dimers are taken overhead and the bottoms product is hydrogenated to saturate the trimers and higher oligomers to create a 5 cSt PAO. This product is further distilled and the distillation cuts blended to produce a 4 cSt PAO and a 6 cSt PAO. The lubricants thus obtained are characterized by a Noack volatility of about 4% to 12%, and a pour point of about −40° C. to −65° C. See also U.S. Pat. No. 6,949,688. (Note that, as used in the present specification, "dimer" includes all possible dimer combinations of the feed, e.g., for a feed comprising C10 and C12, "dimers" comprise a mixture of oligomers containing C20, C22, and C24, otherwise referred to as "$C_{20}$ to $C_{24}$ fractions").

In U.S. Pat. No. 6,869,917 basestocks having a kinematic viscosity between 3.5 and 6.5 cSt, preferably 4.5 and 5.5 cSt (100° C.), are prepared by blending various distillation cuts of the product of oligomerization and then hydrogenating the mixture of oligomers.

U.S. Patent Application 2004/0033908 is directed to fully formulated lubricants comprising PAOs prepared from mixed olefin feed exhibiting superior Noack volatility at low pour points. The PAOs are prepared by a process using an $BF_3$ catalyst in conjunction with a dual promoter comprising alcohol and alkyl acetate, and the products are the result of blending of cuts.

U.S. patent application Ser. No. 11/338,231 describes trimer rich oligomers produced by a process including contacting a feed comprising at least one α-olefin with a catalyst comprising $BF_3$ in the presence of a $BF_3$ promoter comprising an alcohol and an ester formed therefrom, in at least one continuously stirred reactor under oligomerization conditions. Products lighter than trimers are distilled off after polymerization from the final reactor vessel and the bottoms product is hydrogenated. The hydrogenation product is then distilled to yield a trimer-rich product. In preferred embodiments, the feed comprises at least two species selected from 1-octene, 1-decene, 1-dodecene, and 1-tetradecene.

A document entitled "Next Generation Polyalphaolefins—the next step in the evolution of synthetic hydrocarbon fluids", Moore et al., Innovene USA LLC Nov. 22, 2005 revision; posted Nov. 22, 2005 at www.innovene.com (last visited Mar. 1, 2006) discusses PAOs based on C10 PAOs and C12/C14 PAOs.

It is becoming increasing more difficult for the industry to keep up with the demand for lubricating basestocks having properties similar to C10-based PAOs. It would be highly beneficial if the range of linear alphaolefins that could be used to make such basestocks could be extended. The present inventors have surprisingly discovered that under appropriate conditions compositions comprising 1-decene and 1-dodecene may be oligomerized to yield useful basestocks having properties, in preferred embodiments, similar to 1-decene-based PAOs.

SUMMARY OF THE INVENTION

The invention relates to a method of oligomerization comprising recovering the product of direct synthesis of the oligomerization of 1-decene and 1-dodecene to produce low viscosity PAO in the range of 6 to 10 cSt (100° C.).

In a preferred embodiment, the mixture of LAOs and catalyst system is oligomerized in a series of at least two continuously stirred tank reactors and the product of the direct synthesis is recovered after stripping off the catalyst and promoters via low pressure and high temperature dissociation.

The catalyst system is preferably a mixture of $BF_3$ promoted with 1-propanol, 1-butanol, and/or 1-pentanol In embodiments, a product of the process of the invention may be characterized as a 6 cSt (100° C.) PAO having a pour point of less than −54° C.

In embodiments, a product of the process of the invention may be characterized as a 8 cSt (100° C.) PAO having a pour point of less than −48° C.

In embodiments, a product of the process of the invention may be characterized as a 10 cSt (100° C.) PAO having a pour point of less than −45° C.

These and other objects, features, and advantages will become apparent as reference is made to the following detailed description, preferred embodiments, examples, and appended claims.

DETAILED DESCRIPTION

According to the invention, a mixture of alphaolefins comprising 1-decene, 1-dodecene is oligomerized in the presence of an alphaolefin oligomerization catalyst and a cocatalyst comprising an alcohol to provide a product characterized by a viscosity at 100° C. of from about 6 to about 10 cSt.

In a preferred embodiment, the reaction is carried out in a series of at least two continuously stirred tank reactors. Residence time, temperature, and pressure in each reactor may be determined by one of ordinary skill in the art in the presence of the present disclosure without more than routine experimentation, but as a rule of guidance the residence times will range from about 0.1 to about 10 hours, more typically about 0.75 to about 5 hours, the temperature will be about 15 to 70° C., and pressure will be about 2 to 50 psig. The residence time in the first reactor may be shorter than, the same as, or longer than the residence time in the second reactor. It is preferred that the product be taken off from the final reactor when the reaction mixture has reached steady state, which may be determined by one of ordinary skill in the art. The catalyst system comprising catalyst (i.e., BF3) and promoter (i.e., alcohol) is removed, preferably by stripping the catalyst system off in a flash distillation step at low pressure and high temperature. Unreacted monomers and dimers are then removed by batch distillation in laboratory set up. In commercial practice, this is preferably accomplished via continuous distillation using one or two distillation columns. The catalyst system, monomers and dimers may all be recovered and reused, such as by recycling in the same process. The bottoms product of the direct synthesis is then hydrogenated to saturate oligomers.

The feed to the first reactor comprises a mixture of 1-decene and 1-dodecene. Mixtures in all proportions may be used, e.g., from about 5 wt % to about 95 wt % 1-decene, and from about 5 wt % to about 95 wt % 1-dodecene. In preferred embodiments, 1-decene is present in the amount of about 55 to about 95 wt % or about 65 to about 85 wt % or about 70 to about 80 wt % and 1-dodecene is present in the amount of about 45 to about 5 wt % or about 35 to about 15 wt % or about 30 to about 20 wt %, with ranges from any lower limit to any higher limit just disclosed also contemplated as preferred embodiments. Numerous other ranges are contemplated, such as ranges plus or minus 5° C. (±5° C.) from those specified in the examples.

While minor proportions of other linear alphaolefins (LAO) may be present, such as 1-octene, in preferred embodiments the feed consists essentially of 1-decene and 1-dodecene, wherein the phrase "consists essentially of" (or "consisting essentially of" and the like) means that no other LAO is present (or for that matter nothing else is present) that would affect the basic and novel features of the present invention. In yet another preferred embodiment the feed consists of 1-decene and 1-dodecene meaning that no other olefin is present (allowing for inevitable impurities).

In an embodiment, the olefins used in the feed are co-fed into the reactor. In another embodiment, the olefins are fed separately into the reactor. In either case, the catalyst/promoters may also be feed separately or together, with respect to each other and with respect to the LAO species. The catalyst system comprising catalyst and promoter may be completely or partially present when the LAO(s) are added or the catalyst system may be added entirely after the LAO(s) are present in the first reactor.

Alcohols useful in the process of the invention are selected from C1-C10 alcohols, more preferably C1-C6 alcohols. They may be straight-chain or branched alcohols. Preferred alcohols are n-propanol, n-butanol, n-pentanol, and mixtures thereof.

The exact nature of the catalyst system may be more or less of an adduct of BF3:alcohol and/or complexed or adducted with the monomers and oligomerization product and/or intermediates; accordingly, the disclosure should be read as in the nature of a recipe.

In this process, it is preferred that the ratio of the catalyst to cocatalyst or promoter is 0.4 to 0.1 but a wider range of ratios is contemplated, such as between 1 to 0.01 The proper ratio can be determined by one of ordinary skill in the art in possession of the present disclosure.

It is preferred that the catalyst is boron trifluoride (BF3). It is preferred that the catalyst system (i.e., catalyst and promoter) be introduced into the reactor simultaneously with feed (i.e., cofed). In the case of more than one continuously stirred reactor connected in series, it is preferred that BF3, cocatalyst and olefin feed be introduced only to the first reactor. It is further preferred that the reaction zone(s) contain an excess of boron trifluoride, which is governed by the pressure and partial pressure of the boron trifluoride. In this regard, it is preferred that the boron trifluoride be maintained in the reaction zone at a pressure of about 2 to about 500 psig, preferably about 2 to 50 psig (1 psi=703 kg/$m^2$). Alternatively, the boron trifluoride can be sparged into the reaction mixture, along with other known methods for introducing the boron trifluoride to the reaction zone.

While discussed above, it will be noted that suitable temperatures for the reaction may be considered conventional and can vary from about −20° C. to about 90° C., with a range of about 15° to 70° C. being preferred. Appropriate residence times in each reactor, and other further details of processing, are within the skill of the ordinary artisan, in possession of the present disclosure, with further guidance given elsewhere in this disclosure.

In an embodiment, after steady-state conditions are achieved in the final reactor, the catalyst system is flashed off via low pressure and high temperature dissociation. Unreacted monomers and dimers are then separately distilled off. In an alternative these two steps may be combined into a single distillation step. The bottoms product is then hydrogenated to saturate trimers and higher order oligomers. This hydrogenated product, the direct synthesis product, is the desired product, having a nominal viscosity of between about 6 cSt (100° C.) and 10 cSt (100° C.). The term "nominal" as used herein means the number determined experimentally is rounded to the nearest integer.

The following examples are meant to illustrate the present invention, and it will be recognized by one of ordinary skill in the art in possession of the present disclosure that numerous modifications and variations are possible. Therefore, it is to be understood that within the scope of the appended claims, the invention may be practiced otherwise than as specifically described herein.

Laboratory experiments were carried out using $BF_3$ as the catalyst and $BF_3$ promoted with 1-propanol, 1-butanol and 1-pentanol as the co-catalysts for oligomerization of linear alpha olefin mixture, and reported in the tables below. A series of 2-CSTRs (Continuous Stirred Tank Reactor) were used. The olefin mixture, the catalyst and the promoter were co-fed in the first reactor. The partially reacted mixture was then fed into the second reactor where the reaction was completed. The temperature in the reactors was maintained at a specific value via external cooling. The reaction mixture was stripped off the catalyst and co-catalyst (promoter) via low pressure and high temperature dissociation. Any unconverted monomer and excess dimer in the reaction mixture were removed by batch distillation. Unconverted monomer olefin are optionally recycled back into the first reactor along with the fresh olefin. The stripped material from distillation was hydrogenated to final product. This procedure generally produces a PAO and a dimer co-product. Experiments were carried out with different (molecular weight) olefins, with a differing olefin ratio in the feed, and by varying the oligomerization conditions.

The physical property data for PAOs produced commercially by direct synthesis using 1-decene or 1-octene/1-decene/1-dodecene mixture are shown in the table below for comparison. The associated reaction parameters are also given. The property of key interest, pour point, has a value of −57° C. for both products. Laboratory oligomerization of a 75/25-wt % mixture of $C_{10}/C_{12}$ olefins resulted in a PAO with identical pour point (Examples 3 & 4). In all these examples, the co-catalyst used is the same. The reaction temperature used in Example 4 is higher than that used in Examples 1 and 2. This was done in order to compensate for the linearity of the oligomer molecules produced from 1-dodecene. A PAO with a similar pour point was also obtained when the content of 1-dodecene in the feed was increased to 30% as shown in Examples 5 & 6. Oligomerization experiments with $C_{12}$ olefin alone, however, caused the PAO pour point to increase to −39° C. demonstrated by Example 7.

TABLE 1

| Ex. | Feed Olefin | Reaction Temperature, ° F. | Co-catalyst | 100 C. Viscosity, cSt | VI | Pour Point, C. |
|---|---|---|---|---|---|---|
| 1 | $C_{10}$ | 65 | 1-Propanol | 5.85 | 132 | −57 |
| 2 | 10/60/30 $C_8/C_{10}/C_{12}$ | 70 | 1-Propanol | 5.85 | 134 | −57 |
| 3 | 75/25 $C_{10}/C_{12}$ | 70 | 1-Propanol | 5.85 | 139 | −57 |
| 4 | 75/25 $C_{10}/C_{12}$ | 77 | 1-Propanol | 5.92 | 139 | −57 |
| 5 | 70/30 $C_{10}/C_{12}$ | 73 | 1-Propanol | 5.79 | 139 | −57 |
| 6 | 70/30 $C_{10}/C_{12}$ | 77 | 1-Propanol | 5.88 | 139 | −57 |
| 7 | $C_{12}$ | 81 | 1-Propanol | 5.90 | 151 | −39 |

The physical property data for commercial 8 cSt PAOs, obtained with 1-decene or 1-octene/1-decene/1-dodecene mixture are shown in the table below (examples 1 and 2).

TABLE 2

| Example | Feed Olefin | Reaction Temperature, ° F. | Co-catalyst | 100 C. Viscosity, cSt | VI | Pour Point, ° C. |
|---|---|---|---|---|---|---|
| 1 | $C_{10}$ | 65 | 1-Pentanol | 8.0 | 140 | −51 |
| 2 | 10/60/30 $C_8/C_{10}/C_{12}$ | 70 | 1-Pentanol | 8.0 | 141 | −51 |
| 3 | 70/30 $C_{10}/C_{12}$ | 73 | 1-Pentanol | 7.95 | 142 | −51 |
| 4 | 70/30 $C_{10}/C_{12}$ | 77 | 1-Pentanol | 7.89 | 141 | −51 |
| 5 | 70/30 $C_{10}/C_{12}$ | 73 | 1-Butanol | 7.92 | 141 | −51 |
| 6 | 65/35 $C_{10}/C_{12}$ | 77 | 1-Pentanol | 7.86 | 141 | −48 |
| 7 | 60/40 $C_{10}/C_{12}$ | 73 | 1-Pentanol | 8.2 | 142 | −48 |
| 8 | 60/40 $C_{10}/C_{12}$ | 77 | 1-Pentanol | 8.1 | 142 | −48 |
| 9 | $C_{12}$ | 81 | 1-Pentanol | 8.0 | 151 | −36 |

Also described in the table are the reaction parameters. A pour point of −51° C. is obtained for the product. A similar pour point was also obtained on oligomerization of a 70/30-wt % mixture of $C_{10}/C_{12}$ olefins (examples 3, 4 and 5) both with 1-pentanol as well as 1-butanol as the co-catalysts. The pour point increased to −48° C. when the content of 1-dodecene in the feed was increased (65/35 wt % and 60/40 wt % mixtures of $C_{10}/C_{12}$ olefins, examples 6, 7 and 8). The pour point of the PAO produced with $C_{12}$ olefin alone was significantly higher at −36° C. It is thus observed that an 8 cSt PAO with desirable low pour point can not be produced with feed olefins having carbon number of 12. A carefully controlled composition of $C_{10}/C_{12}$ olefins is required to produce an 8 cSt PAO with the desired pour point.

The physical property data for commercial 10 cSt PAOs, obtained with 1-decene or 1-octene/1-decene/1-dodecene mixture are shown in the table below (Examples 1 and 2). Also described in the table are the reaction parameters. A pour point of −48° C. is obtained for the product. Laboratory oligomerizations with a 70/30-wt % mixture of $C_{10}/C_{12}$ olefins also gave a similar pour point PAO (Examples 3 and 4).

TABLE 3

| Example | Feed Olefin | Reaction Temp, ° F. | Co-catalyst | 100 C. Viscosity, cSt | VI | Pour Point, ° C. |
|---|---|---|---|---|---|---|
| 1 | $C_{10}$ | 65 | 1-Pentanol | 10.0 | 136 | −48 |
| 2 | 10/60/30 $C_8/C_{10}/C_{12}$ | 70 | 1-Pentanol | 9.95 | 137 | −48 |
| 3 | 70/30 $C_{10}/C_{12}$ | 73 | 1-Pentanol | 9.86 | 138 | −48 |
| 4 | 70/30 $C_{10}/C_{12}$ | 77 | 1-Pentanol | 9.94 | 138 | −48 |

It is thus seen that a 10 cSt PAO with the desired low pour point can be obtained with a 1-decene/1-dodecene olefin mixture.

Kinematic Viscosity (K.V.) were measured according to ASTM D445 at the temperature indicated (e.g., 100° C. or −40° C.).

Viscosity Index (VI) was determined according to ASTM D-2270.

Noack volatility was determined according to the ASTM D5800 method, with the exception that the thermometer calibration is performed annually rather than biannually.

Pour point was determined according to ASTM D97.

Oligomer distribution was determined by using the Hewlett Packard (HP) 5890 Series II Plus GC, equipped with flame ionization detector (FID) and capillary column.

The low viscosity PAOs made according to the present invention are useful by themselves as lubricants or functional fluids, or they may be mixed with various conventional additives. They may also be blended with other basestocks, such as API Groups I-III and V, or other conventional PAOs (API Group IV) and also other hydrocarbon fluids, e.g., isoparaffins, normal paraffins, and the like. It has surprisingly been found that PAOs according to the invention may advantageously be blended with significant quantities of Group III basestocks into lubricant compositions that meet the property requirements of SAE Grade OW multigrade engine oil formulations. Group III basestocks by themselves do not have the necessary viscometrics required for 0W30 and 0W40 engine oil formulations. Such formulations are described in commonly-assigned, copending U.S. application Ser. No. 11/338,456.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein.

The invention has been described above with reference to numerous embodiments and specific examples. Many variations will suggest themselves to those skilled in this art in light of the above detailed description. All such obvious variations are within the full intended scope of the appended claims, but particularly preferred embodiments include: a process for the oligomerization of alphaolefins comprising: (a) contacting a mixture of alphaolefins comprising 1-decene and 1-dodecene with an oligomerization system comprising BF3 and an alcohol promoter, in at least one continuously stirred reactor under oligomerization conditions for a time sufficient to achieve a steady state reaction mixture; (b) fractionating (such as by flashing or distilling) the steady state reaction mixture of step (a) to obtain as overheads unreacted alphaolefin monomers and dimers and as a bottoms product trimers and higher oligomers of said mixture of alphaolefins; (c) hydrogenating at least a portion of said bottoms product to obtain a hydrogenated bottoms product, said process further characterized by preferred embodiments including: a further step of recovering a low viscosity PAO from said hydrogenated bottoms product, particularly wherein said low viscosity PAO is characterizable by a nominal viscosity of 6 or 8 or 10 cSt (100° C.), and/or a pour point of less than −45° C. or less than −51° C., or less than −54° C.; wherein said alcohol is selected from 1-propanol, 1-butanol, 1-pentanol and mixture thereof; wherein said process occurs in at least two continuously stirred reactors connected in series; and also embodiments wherein the process further comprises a step of blending said low viscosity PAO with at least one basestock selected from API Groups I-III, and/or a step of blending said low viscosity PAO with at least one other material selected from conventional PAOs, isoparaffins, and normal paraffins, particularly preferred wherein said process further comprises a step of blending said low viscosity PAO with at least one basestock selected from API Group III to prepare a blended basestock and then formulating a SAE Grade OW multigrade engine oil from said blended basestock, such as a SAE Grade 0W30 multigrade engine oil or a SAE Grade 0W40 multigrade engine oil. Other preferred embodiments include a SAE Grade OW multigrade engine oil formulation comprising at least one API Group III basestock and at least one PAO made by a process of the invention.

Also a preferred embodiment is the use of any of the foregoing or combinations of the foregoing (as would be recognized by one of ordinary skill in the art in possession of this disclosure) in lubricant compositions and other functional fluids, such as hydraulic fluids, diluents, and the like.

What is claimed is:

1. A process for the oligomerization of alphaolefins comprising:

(a) contacting a mixture of alphaolefins comprising 1-decene and 1-dodecene with an oligomerization system consisting essentially of BF3 and an alcohol promoter, in at least one continuously stirred reactor under oligomerization conditions for a time sufficient to achieve a steady state reaction mixture;

(b) fractionating the steady state reaction mixture of step (a) to obtain as overheads unreacted alphaolefin monomers and dimers and as a bottoms product trimers and higher oligomers of said mixture of alphaolefins;

(c) hydrogenating at least a portion of said bottoms product to obtain a hydrogenated bottoms product; and (d) recovering a low viscosity PAO from said hydrogenated bottoms product, the low viscosity PAO being selected from the group consisting of a PAO having a nominal kinematic viscosity of 6 cSt (100° C.) and a pour point of less than −56° C., a PAO having a nominal kinematic viscosity of 8 cSt (100° C.) and a pour point of less than −48° C., and a PAO having a nominal kinematic viscosity of 10 cSt (100° C.) and a pour point of less than −45° C.

2. The process according to claim 1, wherein said low viscosity PAO has a nominal kinematic viscosity of 6 cSt (100° C.) and a pour point of less than −54° C.

3. The process according to claim 1, wherein said low viscosity PAO has a nominal kinematic viscosity of 8 cSt (100° C.) and a pour point of less than −48° C.

4. The process according to claim 1, wherein said low viscosity PAO has a nominal kinematic viscosity of 10 cSt (100° C.) and a pour point of less than −45° C.

5. The process according to claim 1, wherein said low viscosity PAO has a pour point of less than −51° C.

6. The process according to claim 1, wherein said low viscosity PAO has a pour point of less than −54° C.

7. The process according to claim 1, wherein said alcohol is selected from 1-propanol, 1-butanol, 1-pentanol and mixture thereof.

8. The process according to claim 1, wherein said process occurs in at least two continuously stirred reactors connected in series.

9. The process according to claim 1, further comprising a step of blending said low viscosity PAO with at least one basestock selected from API Groups I-III and V.

10. The process according to claim 1, further comprising a step of blending said low viscosity PAO with at least one other material selected from conventional PAOs, isoparaffins, and normal paraffins.

11. The process according to claim 1, further comprising a step of blending said low viscosity PAO with at least one basestock selected from API Group III to prepare a blended basestock.

12. The process according to claim 11, further comprising a step of formulating a SAE Grade OW multigrade engine oil from said blended basestock.

13. The process according to claim 12, wherein said multigrade engine oil is a SAE Grade 0W30 multigrade engine oil.

14. The process according to claim 12, wherein said multigrade engine oil is a SAE Grade 0W40 multigrade engine oil.

15. The process according to claim 1, wherein the oligomerization conditions includes a reaction temperature in the range of 15° to 70° C.

16. The process according to claim 15, wherein the reaction temperature is in the range of 21° to 25° C.

17. The process according to claim 1, wherein the mixture of alphaolefins contains about 55 to about 95 wt % of 1-decene and about 45 to about 5 wt % of 1-dodecene.

18. The process according to claim 1, wherein the mixture of alphaolefins contains about 65 to about 85 wt % of 1-decene and about 35 to about 15 wt % of 1-dodecene.

* * * * *